US008079452B2

(12) United States Patent
Drew et al.

(10) Patent No.: US 8,079,452 B2
(45) Date of Patent: Dec. 20, 2011

(54) CHECKPOINT CARRYING CASE

(75) Inventors: Jason V. Drew, Shoreview, MN (US); Hieu V. Nguyen, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 347 days.

(21) Appl. No.: 12/464,230

(22) Filed: May 12, 2009

(65) Prior Publication Data

US 2010/0288591 A1 Nov. 18, 2010

(51) Int. Cl.
*A45C 3/00* (2006.01)

(52) U.S. Cl. ..... 190/109; 24/712

(58) Field of Classification Search ..... 190/109; 24/694, 712.5, 712
See application file for complete search history.

(56) References Cited

U.S. PATENT DOCUMENTS

| | | | | |
|---|---|---|---|---|
| 424,324 | A * | 3/1890 | Marshall | 224/582 |
| 5,240,106 | A | 8/1993 | Plath | |
| 5,311,972 | A | 5/1994 | Plath | |
| 5,330,049 | A | 7/1994 | Bertelsen et al. | |
| 5,353,900 | A | 10/1994 | Stilley | |
| 5,355,829 | A * | 10/1994 | Waddell et al. | 114/361 |
| 5,450,993 | A | 9/1995 | Guerrero et al. | |
| 5,505,297 | A | 4/1996 | Myers | |
| 5,547,052 | A | 8/1996 | Latshaw | |
| 6,105,764 | A | 8/2000 | Scicluna et al. | |
| 6,109,496 | A | 8/2000 | Andrew et al. | |
| 6,213,267 | B1 | 4/2001 | Miller | |
| 6,644,448 | B2 * | 11/2003 | Bernbaum et al. | 190/111 |
| D483,940 | S * | 12/2003 | Dolan | D3/217 |
| 6,715,594 | B2 | 4/2004 | Milionta et al. | |
| 6,837,346 | B2 | 1/2005 | Hollingsworth | |
| 7,007,421 | B2 | 3/2006 | Kirschhoffer et al. | |
| 7,293,635 | B2 | 11/2007 | Repke et al. | |
| 7,658,019 | B2 * | 2/2010 | Reagan et al. | 36/50.1 |
| 2004/0134813 | A1 | 7/2004 | Domotor | |
| 2004/0211634 | A1 * | 10/2004 | Chan | 190/108 |
| 2006/0006036 | A1 | 1/2006 | Godshaw et al. | |
| 2006/0102677 | A1 | 5/2006 | Nassanian | |
| 2008/0235995 | A1 * | 10/2008 | Reagan et al. | 36/117.1 |
| 2009/0223765 | A1 * | 9/2009 | Bosma | 190/108 |
| 2009/0314594 | A1 * | 12/2009 | Harrison et al. | 190/109 |

FOREIGN PATENT DOCUMENTS

WO 2007120254 A2 10/2007

OTHER PUBLICATIONS

MobileEdge, "ScanFast Checkpoint Friendly Laptop Cases", http://www.mobileedge.com/scanfast, pp. 1-3, at least by Oct. 21, 2008.

(Continued)

*Primary Examiner* — Tri Mai
(74) *Attorney, Agent, or Firm* — Leanne Taveggia Farrell; Westman, Champlin & Kelly, P.A.

(57) ABSTRACT

A carrying case includes a first compartment and a second compartment coupled to each other at attached ends by a hinge and detachably coupled to each other at free ends by at least one fastener. The at least one fastener includes a clip coupled to the first compartment and a cord coupled to the second compartment. The clip is configured to receive the cord to secure the free ends of the first compartment and the second compartment together.

19 Claims, 5 Drawing Sheets

OTHER PUBLICATIONS

Travelon, "Travelon Checkpoint Friendly Laptop Cases", http://ww.travelonbags.com/, pp. 1-5, at least by Oct. 21, 2008.
Briggs & Riley Travelware, "Birggs & Riley to be First to Market with Travel Sentry Approved Checkpoint-Friendly Laptop Sleeve", http://www.briggs-riley.com/pr-july2008.asp, pp. 1-3, at least by Oct. 21, 2008.
Tom Bihn, "Checkpoint Flyer", http://www.tombihn.com/page/001/PROD/TBP/TB1701, pp. 1-3, at least by Oct. 21, 2008.
Transportation Security Administration, ""Checkpoint Friendly" Laptop Bag Procedures", http://www.tsa.gov/press/happenings/simplifying_laptop_bag_procedures.shtm., pp. 1-2, at least by Oct. 29, 2008.
MobileEdge, "ScanFast Checkpoint Friendly Briefcase", http://mobileedge.com/laptop-bag-collections/scanfast-checkpoint-friendly-laptop-bags/scanfast-checkpoint-friendly-laptop..., pp. 1-3, at least by Oct. 21, 2008.
"Checkpoint Friendly Compu Brief by Pathfinder to Reduce Hassles in the Airport", pp. 1-3, Aug. 2008.
Targus, "Product Specification Sheet Targus Zip-Thru 15.4" Corporate Traveler Laptop Case Part #: CUCT02AU15S, pp. 1-2, at least by Oct. 21, 2008.
Press Release, Transportation Security Administration, "TSA Ready for 'Checkpoint Friendly' Laptop Bags", p. 1-1, Aug. 5, 2008.
Transportation Security Administration, "Laptop Bags: Industry Process and Guidelines", pp. 1-3, Jul. 29, 2008.

* cited by examiner

CHECKPOINT CARRYING CASE

BACKGROUND

A carrying case or bag is commonly used to carry personal items and/or business-related items when traveling. The carrying case provides protective transport and storage for multiple different items of a user.

The Transportation Security Administration (TSA) allows electronic devices, such as portable computers, to remain in a bag at a checkpoint as long as the bag provides a clear and unobstructed image of the electronic device while it undergoes screening. For example, a bag could have a designated computer-only section that can be, for example, unfolded from other sections of the bag to lie flat on the scanning belt such that there is nothing above or below it.

The discussion above is merely provided for general background information and is not intended to be used as an aid in determining the scope of the claimed subject matter.

SUMMARY

A carrying case includes a first compartment and a second compartment. The first and second compartments are defined by outer facing surfaces, inner facing surfaces, free ends, attached ends and pairs of opposing side ends. A first edge is defined by an intersection of the inner facing surface and the attached end of the first compartment and a second edge is defined by an intersection of the inner facing surface and the attached end of the second compartment. The first edge and the second edge are coupled together by a hinge. The carrying case also includes at least one fastener having a clip coupled to at least one of the side ends of the first compartment and a cord coupled to at least one of the sides ends of the second compartment. The clip is configured to receive the cord to secure the inner facing surfaces together.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include at least one fastener on a carrying case. The at least one fastener can be fastened when the carrying case is in a folded or closed state and can be unfastened such as to be unfolded or opened for positioning on a belt for screening at a checkpoint without having to remove an electronic device, such as a portable computer, stored inside. The fastener includes a cord located on a first compartment and a clip located on a second compartment. The clip receives the cord when the carrying case is in a folded state and the cord is free from the hook when the carrying case in an unfolded state.

Figure 1:
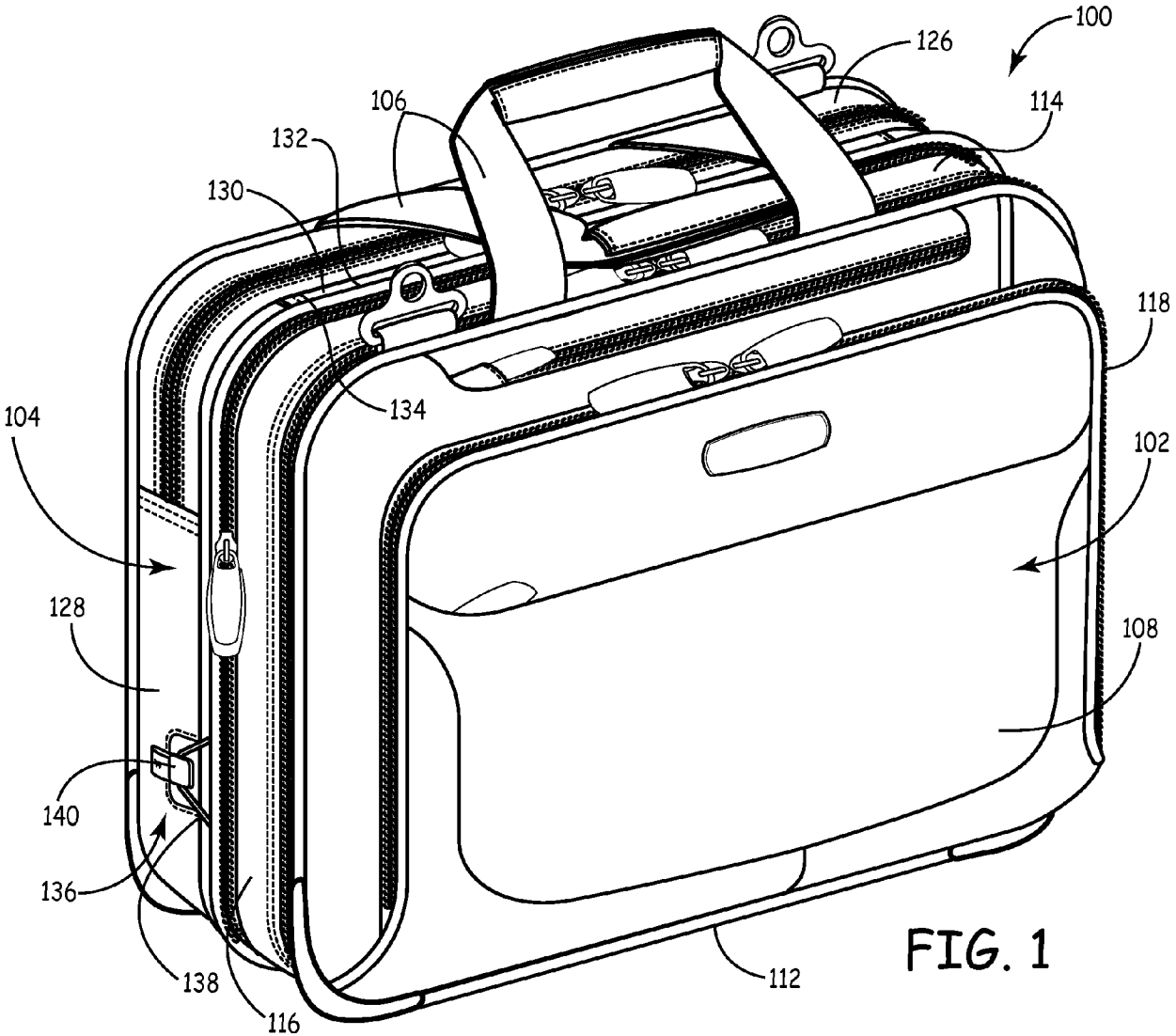
FIG. 1 illustrates a perspective view of a carrying case in a closed state under one embodiment.
Figure 2:
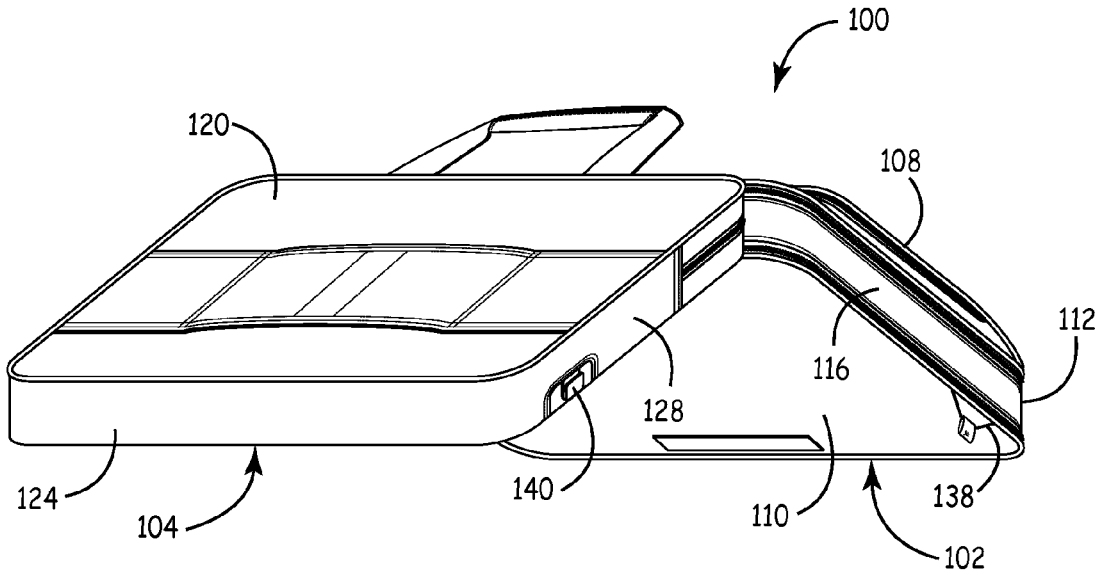
FIG. 2 illustrates a perspective view of a carrying case illustrated in FIG. 1 in an open state.
Figure 3:
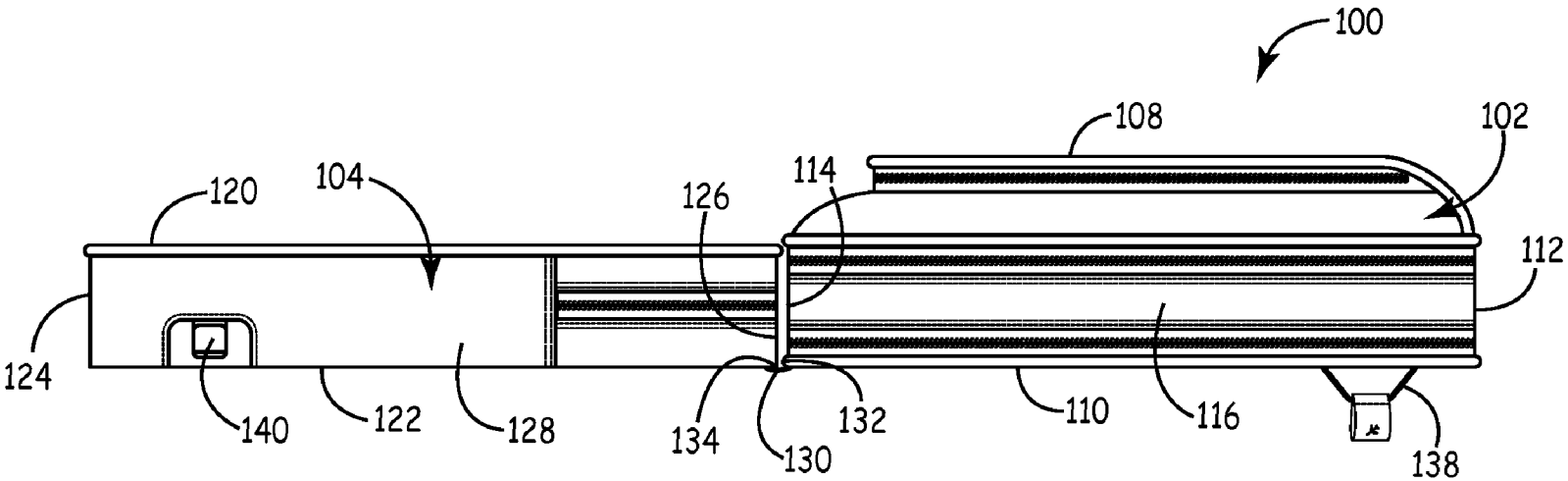
FIG. 3 illustrates a side view of the carrying case illustrated in FIG. 1 in an open state.

FIG. 1 illustrates a perspective view of a carrying case 100 in a folded or closed state under one embodiment, while FIG. 2 illustrates a perspective view of carrying case or bag 100. FIG. 3 illustrates a side view of carrying case 100 in an unfolded or opened state. In the folded state, carrying case 100 can be carried from one location to another location with handles 106. In the unfolded state, carrying case 100 is configured to be screened at a checkpoint station without having to take an electronic device out of the carrying case. As illustrated in FIGS. 1-3, carrying case 100 includes a first compartment or first case 102 and a second compartment or second case 104.

First compartment or first case 102 includes pockets and spaces for storing miscellaneous items. For example, first compartment or first case 102 can be a file compartment for storing files and documents. Second compartment or second case 104, includes a space for storing an electronic device, such as a portable computer. First compartment 102 includes an outer facing surface 108, an inner facing surface 110 (illustrated in FIGS. 2 and 3), a free end 112, an attached end 114 and a pair of opposing side ends 116 and 118 (illustrated in FIG. 1). Second compartment 104 includes an outer facing surface 120, an inner facing surface 122 (illustrated in FIG. 3), a free end 124, an attached end 126 and a pair of opposing side ends 128 and 129 (illustrated more clearly in FIGS. 10-12). As shown in the unfolded state illustrated in FIGS. 2 and 3, first compartment 102 and second compartment 104 are coupled to each other at attached ends 114 and 126 by a hinge 130. As shown in FIGS. 1-3, first and second compartments 102 and 104 are detachably coupled to each other at free ends 112 and 124 by at least one fastener 136.

A first edge 132 of first compartment 102 is defined by an intersection of inner facing surface 110 and attached end 114. A second edge 134 of second compartment 104 is defined by an intersection of inner facing surface 122 and attached end 126. Hinge 130 couples the first edge 132 to the second edge 134. Hinge 130 can be a foldable panel of fabric that is stitched to the first compartment 102 and stitched to the second compartment 104. However, hinge 130 can also be a variety of other configurations. For example, it can be attached to first edge 132 and second edge 134 with other means and be made of other materials, such as plastic.

Carrying case 100 includes at least one fastener 136 to hold free ends 112 and 124 together in the folded state as illustrated in FIG. 1. Although only a single fastener 136 is illustrated in FIGS. 1 and 2, it should be realized that carrying case 100 can include more than one fastener and fasteners can be located not only on side ends 116 and 128, but also on the opposing side ends 118 and 129 (FIG. 9) and on free ends 112 and 124. Fastener 136 includes a cord 138 located on first compartment 102 and a clip 140 located on second compartment 104. It should be realized that in the alternative, cord 138 can be located on second compartment 102 and clip 140 can be located on first compartment 102.

Figure 4:
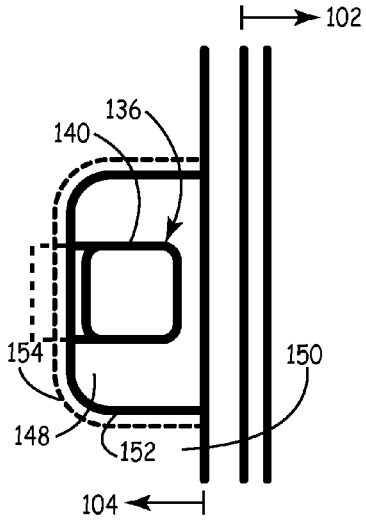
FIG. 4 illustrates an enlarged front view of a portion of a fastener of the carrying case illustrated in FIG. 1.
Figure 5:
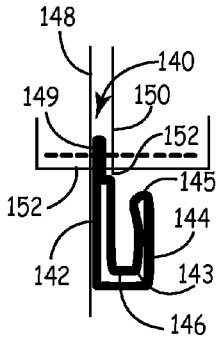
FIG. 5 illustrates an enlarged side view of a portion of the fastener illustrated in FIG. 3.
Figure 6:
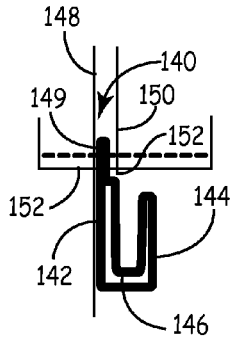
FIG. 6 illustrated an enlarged side view of a portion of a fastener under another embodiment.

FIG. 4 illustrates an enlarged front view of a portion of fastener 136 as mounted to second compartment 104, while FIGS. 5 and 6 illustrate enlarged side views of two different embodiments of a portion of fastener 136. The illustrated portion of fastener 136 in FIGS. 5 and 6 includes a clip 140 having a hook shape and including a base portion 142, a protruding portion 144 and a connecting portion 146 for coupling the base portion 142 to the protruding portion 144. A combination of base portion 142, protruding portion 144 and connecting portion 146 defines a space for securing a remaining portion of fastener 136, which is cord 138. As illustrated in FIG. 5, protruding portion 144 includes a first end 143 coupled to connecting portion 146 and a second end 145. In the embodiment illustrated in FIG. 5, second end 145 of protruding portion 144 can have a thickness greater than first end 143. In the embodiment illustrated in FIG. 6, first end 143 can have a thickness substantially the same as second end 145 or a thickness greater than second end 145. It should be realized that other configurations of protruding portion 144 of clip 140 are possible.

As illustrated in FIGS. 4-6, clip 140 is positioned on a first piece of fabric 148 of second compartment 104. A second piece of fabric 150 is laid on top of the first piece of fabric 148 and includes an opening as defined by fabric line 152. The second piece of fabric 150 is partially laid across part of base portion 142 such that part of base portion 142 is between the first piece of fabric 148 and the second piece of fabric 150. Then, stitching 154 is stitched through the first piece of fabric 148, the second piece of fabric 150 and through part of base portion 142 of clip 140 such that clip 140 is secured between first piece of fabric 148 and second piece of fabric 150. Base portion 142 includes an area of reduced thickness 149. Area 149 of base portion 142 is thin enough to allow stitching to pass through it. The remaining area of base portion 142 is thicker such as to be strong enough to secure cord 138.

Figure 7:
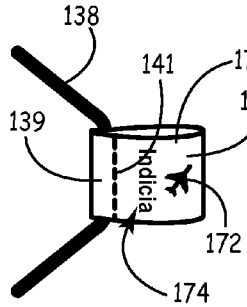
FIG. 7 illustrates an enlarged back view of a remaining portion of the fastener of the carrying case illustrated in FIG. 1.
Figure 8:
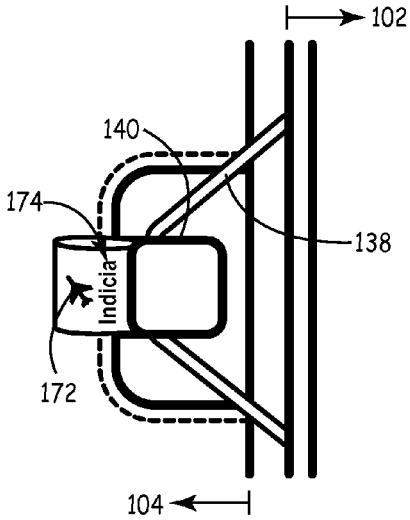
FIG. 8 illustrates an enlarged front view of the fastener engaged with components illustrated in FIGS. 4 and 7.
Figure 9:
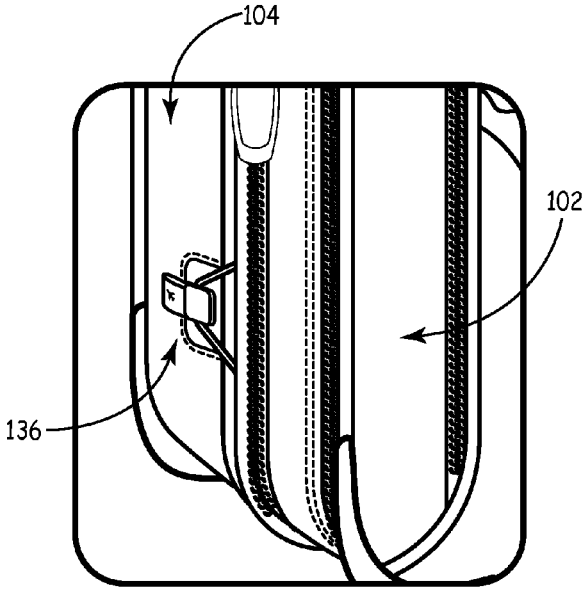
FIG. 9 illustrates an enlarged perspective view of the fastener illustrated in FIG. 7.

FIG. 7 illustrates an enlarged back view of cord 138. Cord 138 can be made of elastic-type cording. For example, the elastic cording can be 2.2 mm in diameter or less. However, it should be realized that other sizes of cording, including larger sizes, can be used. In addition, other types of cording materials, such as polypropylene and nylon, can be used. Attached to cord 138 is a tag 156. In one embodiment, tag 156 is a loop of fabric that is secured around cord 138 to form a collar section 139 formed by stitch line 141. Collar section 139 allows tag 156 to slide along cord 138. The remaining portion of tag 156 provides a loop structure 170 for a user to grab with their fingers or in the alternative, slide a finger through the loop structure, to pull the cord 138 into engagement with clip 140 to form fastener 136 as is illustrated in FIGS. 8 and 9 and to pull cord 138 out of engagement with clip 140. When tag 156 is used to place cord 138 into clip 140, tag 156 can come to rest in contact with at least connecting portion 146 of clip 140.

As illustrated in FIGS. 7 and 8, tag 156 includes a graphic 172 and indicia 174 on opposing sides of the loop structure 170 of fabric. As illustrated in FIGS. 7 and 8, graphic 172 illustrates artwork indicative of the type of place or situation where fastener 136 could be utilized. For example, fastener 136 can be engaged or disengaged in an airport setting. Indicia 174 are indicative of specific instructions or functional language as to how and where fastener 136 could be utilized. For example, Indicia 174 can recite 'checkpoint release' to indicate that the fastener can be engaged or disengage at checkpoints.

FIG. 8 illustrates cord 138 as attached to first compartment 102 at both of its ends to form an enclosed ring for engagement with clip 140, which is attached to second compartment 104. It should be realized, however, that other configurations are possible. For example, cord 138 could be attached to first compartment at only one of its ends. In such an example, cord 138 could be secured to clip 140 between the free end and the attached end of cord 138 by a squeeze tension in clip 140.

FIG. 9 illustrates an enlarged perspective view of fastener 136 on carrying case 100. As illustrated, fastener is coupling first compartment 102 to second compartment 104.

Figure 10:
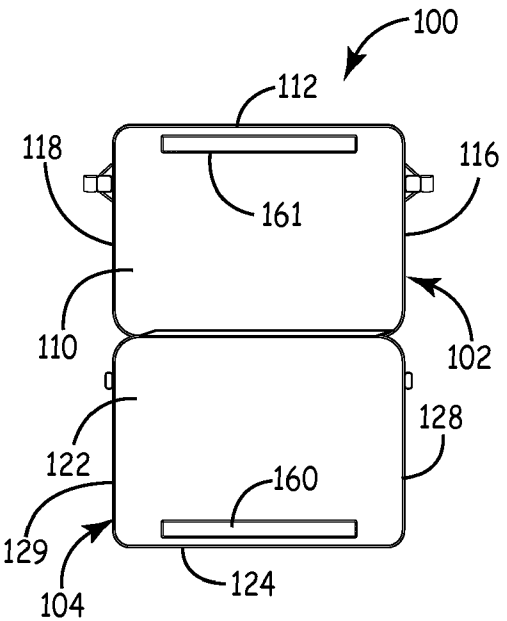
FIGS. 10-12 illustrate various embodiments of use of a hook material and a loop material for further securing the carrying case illustrated in FIG. 1.

FIG. 10 illustrates a top plan view of inner facing surfaces 110 and 122 of carrying case 100 in an unfolded or opened state under one embodiment. FIG. 9 illustrates one embodiment of mounting hook material 160 and loop material 161, such as Velcro®, to inner facing surfaces 110 of first compartment 102 and inner facing surface 122 of second compartment 104, respectively, for added strength in fastening together first and second compartments 102 and 104 when in the folded state. It should be realized that in the alternative, loop material 161 can be mounted to inner facing surface 122 and hook material 160 can be mounted to inner facing surface 110.

FIG. 10 illustrates a top plan view of a carrying case 200 in an unfolded or opened state under another embodiment. FIG. 10 illustrates two pieces of hook material 260 and 262 mounted to inner facing surface 222 and adjacent free end 224 of second compartment 204 and two corresponding pieces of loop material 261 and 263 mounted to inner facing surface 210 and adjacent free end 212 of first compartment 202. Pieces 260 and 262 and corresponding pieces 261 and 263 are spaced apart from each other by a distance. This configuration of hook and loop material illustrated in FIG. 10 allows a user to easily run their fingers between the two pieces of hook and loop material 260 and 262 and 261 and 263 to unfold carrying case 200. It should be realized that in the alternative, loop material 261 and 263 can be mounted to inner facing surface 222 and hook material 260 and 262 can be mounted to inner facing surface 210.

Figure 11:
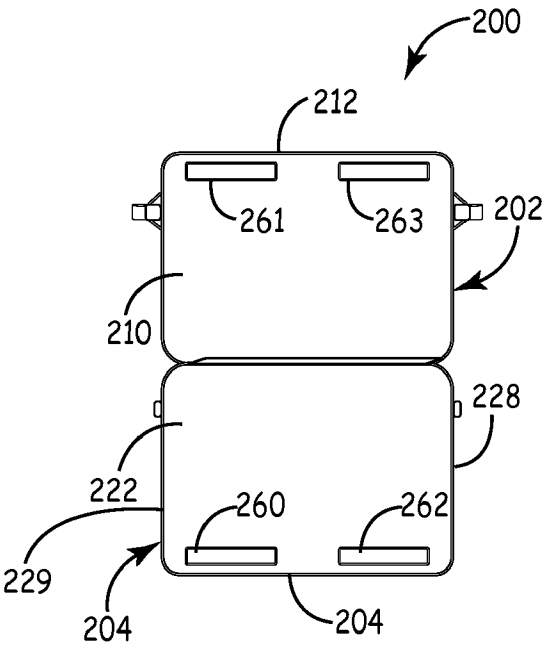
Figure 12:
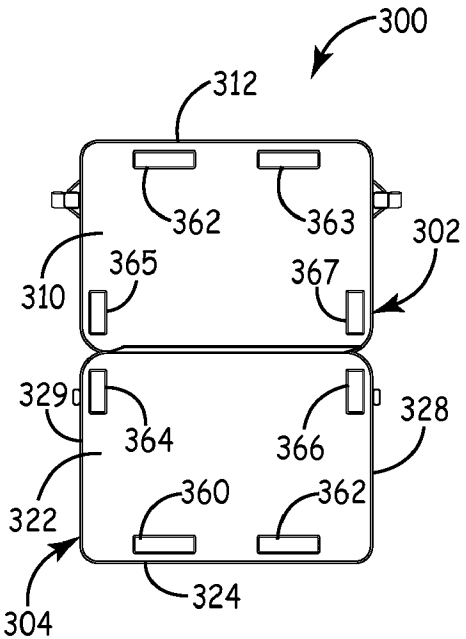

FIG. 11 illustrates a top plan view of a carrying case 300 in an unfolded or opened state under yet another embodiment. FIG. 11 illustrates a plurality of pieces of hook material 360, 362, 364 and 366 mounted to inner facing surface 322 and a plurality of corresponding pieces of loop material 361, 363, 365 and 367 mounted to inner facing surface 310. In particular, first and second pieces 260 and 262 are mounted to inner facing surface 322 adjacent free end 224 of second compartment 304 and corresponding first and second pieces 261 and 263 are mounted to inner facing surface 310 adjacent free end 312. In addition, third and fourth pieces 364 and 366 are mounted to inner facing surface 322 adjacent side ends 329 and 328 and corresponding third and fourth pieces 365 and 367 are mounted to inner facing surface 310 adjacent side ends 318 and 316. The pieces of hook and loop material 364, 365, 366 and 367 located adjacent the side ends provide further secured attachment of first compartment 102 and second compartment 104 in a folded state. It should be realized that in the alternative, loop material 361, 363, 365 and 367 can be mounted to inner facing surface 322 and hook material 360, 362, 364 and 366 can be mounted to inner facing surface 310.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A carrying case comprising:

a first compartment and a second compartment coupled to each other at attached ends by a hinge and detachably coupled to each other at free ends by at least one fastener, the at least one fastener comprising:

a cord coupled to the first compartment;

a clip coupled to the second compartment, the clip configured to receive the cord to secure the free ends of the first compartment and the second compartment together; and a tag attached to the cord and formed of a loop of material, wherein the tag includes a collar section separated from a loop section by a stitch line, the collar section encircling the cord and the loop section extending away from the cord.

2. The carrying case of claim 1, wherein the collar section is slidable along the cord and the loop section allows a user of the carrying case to pull the cord into engagement with the clip.

3. The carrying case of claim 1, wherein the loop section comprises graphics and indicia indicative of functional use of the fastener.

4. The carrying case of claim 1, wherein the cord comprises an elastic cord.

5. The carrying case of claim 1, wherein the clip is stitched to the first compartment.

6. The carrying case of claim 5, wherein the clip is positioned between a first piece of fabric and a second piece of fabric of the second compartment, wherein the stitching goes through the first piece of fabric, the second piece of fabric and a base portion of the clip.

7. The carrying case of claim 1, wherein the clip comprises a base portion for coupling to the first compartment, a protruding portion oriented substantially in parallel with the base portion and a connecting portion coupling the base portion to the protruding portion, the base portion, protruding portion and connecting portion define a space for receiving a portion of the cord.

8. A bag comprising:

a first case defined by an outer facing surface, an inner facing surface, a free end, an attached end and a pair of opposing side ends, the first case configured to store files;

a second case defined by an outer facing surface, an inner facing surface, a free end, an attached end and a pair of opposing side ends, the second case configured to store a portable computer;

a first edge defined by an intersection of the inner facing surface and the attached end of the first case;

a second edge defined by an intersection of the inner facing surface and the attached end of the second case;

a hinge coupling the first edge to the second edge;

at least one fastener comprising:

a cord coupled to at least one of the side ends of the first case; and a hook-shaped clip coupled to at least one of the side ends of the second case that corresponds with the side end that the cord is coupled to, the clip configured to receive the cord to fasten the inner facing surface of the first case to the inner facing surface of the second case and comprising a base portion including a first area of reduced thickness for attaching to the second case and a second area of normal thickness, a protruding portion oriented substantially in parallel with the base portion and a connecting portion coupling the base portion to the protruding portion, wherein the second area of the base portion, the protruding portion and the connecting portion define a space for receiving the cord and are free from attachment to the second case.

9. The bag of claim 8, wherein the tag comprises a collar section separated from a loop section by a stitch line, the collar section encircling the cord and the loop section extending away from the cord.

10. The bag of claim 8, wherein the at least one fastener comprises a pair of fasteners each having a hook-shaped clip and a cord, wherein each of the clips are coupled to each of the side ends of the first case and each of the cords are coupled to each of the side ends of the second case.

11. The bag of claim 8, wherein the cord comprises an elastic cord.

12. The bag of claim 8, wherein the first area of reduced thickness of the base portion of the hook-shaped clip is stitched to the side end of the second case.

13. The bag of claim 12, wherein the first area of reduced thickness of the base portion of the hook-shaped clip is positioned between a first piece of fabric and a second piece of fabric of the second case, wherein stitching goes through the first piece of fabric, the second piece of fabric and the first area of reduced thickness o of the base portion of the hook-shaped clip.

14. The carrying case of claim 8, wherein the inner facing surfaces of the first case and the second case comprise one of a hook material and a loop material to further fasten the inner facing surface of the first case to the inner facing surface of the second case.

15. A method of unfolding a carrying case for screening at a checkpoint, the method comprising:

providing a carrying case having a file compartment and a portable computer compartment coupled to each other at attached ends by a hinge and detachably coupled to each other at free ends;

unfastening at least one fastener, the fastener comprising:

a cord coupled to one of the side ends of the file compartment;

a clip coupled to one of the side ends of the portable computer compartment that corresponds with the side end that the cord is coupled to, the clip configured to receive the cord for attaching the inner facing surface of the file compartment and the inner facing surface of the portable computer compartment together;

a tag attached to the cord and formed of a loop of material, wherein the tag includes a collar section separated from a loop section by a stitch line, the collar section encircling the cord and the loop section extending away from the cord; and placing the carrying case on a moving belt such that the inner facing surfaces of the file compartment and the portable computer compartment lie in contact with the belt for screening.

16. The method of claim 15, wherein unfastening the at least one fastener comprises pulling the tag attached to the cord to remove the cord from the clip, wherein the loop section includes instructional indicia.

17. The method of claim 15, wherein unfastening the at least one fastener comprises unfastening a pair of fasteners each having a clip and a cord, wherein each of the clips are coupled to each of the side ends of the portable computer compartment and each of the cords are coupled to each of the side ends of the file compartment.

18. The method of claim 15, wherein unfastening the at least one fastener comprises unfastening corresponding pieces of hook material and loop material positioned on the inner facing surface of the file compartment and the inner facing surface of the portable computer compartment.

19. The method of claim 15, wherein unfastening the at least one fastener comprises pulling the cord from the clip by sliding a finger through the loop section of the tag and pulling the tag and therefore the cord from the clip.

* * * * *